US009743189B2

(12) United States Patent
Salvatti et al.

(10) Patent No.: US 9,743,189 B2
(45) Date of Patent: Aug. 22, 2017

(54) MICROSPEAKER WITH IMPROVED HIGH FREQUENCY EXTENSION

(71) Applicant: Apple Inc., Cupertino, CA (US)

(72) Inventors: Alexander V. Salvatti, Morgan Hill, CA (US); Daniel K. Boothe, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 14/988,401

(22) Filed: Jan. 5, 2016

(65) Prior Publication Data

US 2017/0195796 A1 Jul. 6, 2017

(51) Int. Cl.

| | |
|---|---|
| ***H04R 7/12*** | (2006.01) |
| ***H04R 7/06*** | (2006.01) |
| ***H04R 9/06*** | (2006.01) |
| ***H04R 9/18*** | (2006.01) |

(52) U.S. Cl.

CPC ..... *H04R 7/122* (2013.01); *H04R 7/06* (2013.01); *H04R 9/06* (2013.01); *H04R 9/18* (2013.01); *H04R 7/127* (2013.01); *H04R 2307/207* (2013.01)

(58) Field of Classification Search

CPC ... H04R 7/00; H04R 7/02; H04R 7/12; H04R 7/16; H04R 7/18; H04R 7/20; H04R 7/22; H04R 7/24; H04R 7/26; H04R 7/122; H04R 7/125; H04R 7/127

See application file for complete search history.

(56) References Cited

U.S. PATENT DOCUMENTS

| | | | | |
|---|---|---|---|---|
| 5,259,036 | A * | 11/1993 | Seeler | H04R 7/125 181/170 |
| 7,483,545 | B2 | 1/2009 | Nagaoka | |
| 8,467,557 | B2 | 6/2013 | Miller et al. | |
| 8,660,279 | B2 | 2/2014 | Varla | |
| 9,036,838 | B2 | 5/2015 | Chen et al. | |
| 2007/0217645 | A1 | 9/2007 | Ishihara | |
| 2007/0297640 | A1* | 12/2007 | Ohashi | H04R 7/16 381/430 |
| 2013/0070953 | A1 | 3/2013 | Dodd et al. | |
| 2014/0087148 | A1* | 3/2014 | Huang | B32B 27/08 428/189 |
| 2015/0075900 | A1* | 3/2015 | Yuen | H04R 7/125 181/168 |
| 2015/0181341 | A1* | 6/2015 | Azmi | H04R 7/04 381/398 |
| 2016/0295329 | A1* | 10/2016 | Chang | H04R 31/00 |

FOREIGN PATENT DOCUMENTS

WO WO-2011135291 11/2011

* cited by examiner

*Primary Examiner* — Matthew Eason

(74) *Attorney, Agent, or Firm* — Blakely, Sokoloff, Taylor & Zafman LLP

(57) ABSTRACT

A decoupled speaker membrane assembly for a microspeaker, the membrane including a first membrane portion, a compliant portion, a second membrane portion and a suspension member. The compliant portion is attached to, and extends radially outward from, an entire perimeter of the first membrane portion. The second membrane portion is attached to, and extends radially outward from the compliant portion such that the second membrane portion is decoupled from the first membrane portion by the compliant portion. The suspension member extends radially outward from the second membrane portion.

20 Claims, 6 Drawing Sheets

MICROSPEAKER WITH IMPROVED HIGH FREQUENCY EXTENSION

FIELD

An embodiment of the invention is directed to a microspeaker having a decoupled sound radiating surface which improves the acoustic performance of a driver within which the membrane may be implemented. Other embodiments are also described and claimed.

BACKGROUND

Whether listening to an MP3 player while traveling, or to a high-fidelity stereo system at home, consumers are increasingly choosing intra-canal and intra-concha earphones for their listening pleasure. Both types of electroacoustic transducer devices have a relatively low profile housing that contains a receiver or driver (an earpiece speaker). The low profile housing provides convenience for the wearer, while also providing very good sound quality.

These devices, however, do not have sufficient space to house high fidelity speakers. This is also true for portable personal computers such as laptop, notebook, and tablet computers, and, to a lesser extent, desktop personal computers with built-in speakers. Such devices typically require speaker enclosures or boxes that have a relatively low rise (e.g., height as defined along the z-axis) and small back volume, as compared to, for instance, stand alone high fidelity speakers and dedicated digital music systems for handheld media players.

The drivers (earpiece speakers) for such devices therefore typically use a low profile diaphragm assembly, which is composed of two parts. Namely, a sound radiating surface (SRS) and a suspension member. The SRS vibrates axially thereby creating pressure waves outside the driver enclosure. The suspension surrounds and suspends the SRS within the enclosure and allows it to vibrate axially. Each of these moving parts, however, have natural structural resonances that can be excited at certain frequencies, which are typically different from one another. As a result, at certain frequencies (the so-called "breakup mode" frequency) portions of the SRS (e.g., the inner portion and the outer portion), and in some cases the suspension member, may move out of phase with one another. In other words, in the case of the SRS, the center or inner portion of the SRS may be moving up while the outer portion or edges of the SRS may be moving down. Such out of phase movements, result in an undesirable sound pressure output (e.g., drop in pressure) at the breakup frequency. One way in which breakup modes have been addressed is to increase the stiffness of the SRS, such as by using a stiffer SRS material or making the SRS thicker. In some cases, however, there are manufacturing constraints and/or undesirable performance trade-offs that come along with a stiffer SRS, and therefore this may not be an option.

SUMMARY

An embodiment of the invention is a decoupled speaker membrane assembly, which improves sound output at a breakup mode frequency of a driver within which the membrane is incorporated. In some embodiments the membrane is a sound radiating surface (SRS) such as a diaphragm designed for use within a driver such as a loudspeaker, more specifically, a microspeaker. The term "microspeaker" is intended to refer to a speaker having a size range (e.g., a diameter or longest dimension) of from about 10 mm to 75 mm, in some cases, within a size range of from 10 mm to 20 mm. The speaker membrane may be separated into two or more portions (i.e. decoupled), for example an inner portion and an outer portion, by a compliant portion. The inner portion may be concentrically inward to the outer portion and the compliant portion may be a compliant member (e.g., a ring shaped membrane) connecting the inner and outer portions together. The inner portion and the compliant member may act as a mass/spring type system that can be tuned to have a natural resonant frequency at the breakup mode frequency where a drop in sound pressure output would normally occur. In particular, the inner portion may be tuned so that the sound pressure output at the breakup mode frequency increases, and therefore the undesirable sound pressure drop previously experienced at the breakup mode frequency is minimized or eliminated altogether. This, in turn, creates additional acoustic output in the high frequencies beyond what is achieved by a homogenous SRS (e.g., an SRS without separate parts).

More specifically, the inner portion and compliant member assembly can be tuned by controlling the size (e.g., area, thickness, etc.) and/or mass of the inner portion and/or the stiffness (or compliance) of the compliant member. In particular, in most cases, the inner portion of the SRS is equal to or smaller in size and mass than the outer portion of the SRS. It should be understood that reducing the mass of the inner portion increases the resonant frequency, while increasing the mass of the inner portion reduces the resonant frequency. Thus, in order to drive the resonant frequency of the inner portion up, which is the goal, the size or mass of the inner portion is reduced, but only to a certain point, otherwise it becomes too small to effectively radiate sound. The size limitations on the inner portion, however, can be compensated for by adjusting the stiffness or compliance of the compliant member in order to achieve the desired resonant frequency.

In particular, increasing the stiffness of the compliant member (i.e. reducing the compliance) increases the resonant frequency of the mass/spring system created by the inner portion and compliant member, while reducing the stiffness of the compliant member (i.e. increasing the compliance) reduces the resonant frequency. Thus, the size or mass of the inner portion can be balanced with the stiffness or compliance of the compliant member in order to tune the assembly to the desired resonant frequency. For example, where the size or mass of the center must be increased (such as by increasing the area), for example to improve sound radiation, the resultant lowered resonant frequency can be compensated for by increasing the stiffness of the compliant member, which increases the resonant frequency. Alternatively, if the size or mass of the center portion is decreased (such as by decreasing the area), the stiffness of the compliant member could be increased to further increase the resonant frequency, or decreased to lower the resonant frequency to a desired level. It should be understood that the stiffness of the compliant member and/or inner portion may be controlled by, for example, controlling a thickness of the material, selecting a different material, and/or otherwise chemically or mechanically altering a portion of the material to locally tune the stiffness. If the compliant member is made of aluminum, for example, one such method of chemically altering the mechanical properties could be anodization. In addition, another way to tune the resonant frequency of the inner portion and compliant member assembly could be to modify a width of the channel between the inner and outer portions. For example, a wider channel, and in turn compliant member with larger area, would reduce the stiffness and lower the resonant frequency, while a narrower channel would increase the stiffness and in turn increase the resonant frequency.

For example, in one embodiment, the SRS consists of an SRS material attached to a compliant membrane that is continuous with a suspension member. The SRS material may be a relatively stiff material, which is stiffer than the compliant membrane. To decouple inner and outer portions of the SRS and create a high frequency resonator within the SRS, a ring of the SRS material is removed, leaving only the compliant membrane between the remaining inner and outer portions of the SRS material. In this aspect, the inner portion of SRS material and compliant membrane provide the mass/spring assembly, which is tuned to have a natural resonance frequency at the breakup mode frequency as previously discussed.

More specifically, a decoupled speaker membrane assembly includes a first membrane portion, a compliant portion, a second membrane portion and a suspension member. The compliant portion may be attached to, and extends radially outward from, an entire perimeter of the first membrane portion. The second membrane portion may be attached to, and extend radially outward from the compliant portion such that the second membrane portion is decoupled from the first membrane portion by the compliant portion. The suspension member may extend radially outward from the second membrane portion. The first membrane portion may be tuned to have a natural resonant frequency at a breakup mode frequency of the speaker membrane. In addition, a channel may be formed between the first membrane portion and the second membrane portion, and the channel may be dimensioned to tune a natural resonant frequency of the first membrane portion to that of a breakup mode frequency of the speaker membrane. Still further, the compliant portion may be more compliant than the first membrane portion and the second membrane portion. In addition, the second membrane portion may be attached to, and extend radially outward from, an entire perimeter of the compliant portion. The compliant portion may acoustically seal the first membrane portion to the second membrane portion. The first membrane portion and the second membrane portion may be formed of a same material. Still further, the compliant portion may be formed by a portion of the suspension member extending between the first membrane portion and the second membrane portion, and the first membrane portion and the second membrane portion may be attached to a face of the suspension member. In addition, the first membrane portion and the second membrane portion may include a plurality of material layers, and at least one of the material layers may extend from the first membrane portion to the second membrane portion to form the compliant portion. The suspension member may be attached to a face of the at least one of the material layers.

In another embodiment, the SRS consists of layers of SRS materials, for example, thin layers of aluminum sandwiched around a core material. The core material may be a relatively low mass material (e.g. lower mass density than the aluminum layers) and have good internal damping characteristics. To decouple inner and outer portions of the SRS, a ring of only one of the aluminum layers and the core material may be removed, leaving behind inner and outer SRS portions that are connected together by the remaining aluminum layer. The ring of aluminum creates a compliant region between the inner and outer portions of the SRS. The inner portion and compliant region are tuned to have a natural resonance frequency within the frequency range of the breakup mode frequency in order to minimize or eliminate the drop in sound pressure output as previously discussed.

More specifically, a decoupled speaker diaphragm may include an inner diaphragm portion, an outer diaphragm portion and a decoupling membrane. The outer diaphragm portion may be spaced concentrically outward from the inner diaphragm portion. The decoupling membrane may be positioned between the inner diaphragm portion and the outer diaphragm portion. In addition, the decoupling membrane may surround the inner diaphragm portion and be more compliant than the inner diaphragm portion and the outer diaphragm portion. The inner diaphragm portion and the outer diaphragm portion may be within a first plane and the decoupling membrane may be within a second plane parallel to the first plane. In one aspect, a top side of the decoupling membrane may be attached to a bottom side of the inner diaphragm portion and the outer diaphragm portion. In addition, the decoupling membrane may include an inner edge and an outer edge, the inner edge of the decoupling membrane may be connected to an outer edge of the inner diaphragm portion, and the outer edge of the decoupling membrane may be connected to an inner edge of the outer diaphragm portion. In some embodiments, the inner diaphragm portion and the outer diaphragm portion may include a first material layer and a second material layer, and the decoupling membrane includes one of the first material layer or the second material layer. In another aspect, the membrane is a continuous membrane that extends along an entire bottom side of the inner diaphragm portion and the outer diaphragm portion, and the bottom side of the inner diaphragm portion and the outer diaphragm portion is attached to a top side of the decoupling membrane. Still further, the membrane may include a suspension member extending radially outward from the outer diaphragm portion. The inner diaphragm portion and the outer diaphragm portion may, in one embodiment, include at least one different material than the suspension member.

In another embodiment, a driver includes a frame, a membrane assembly and a voice coil connected to a face of the membrane assembly. The membrane assembly may be for radiating sound and include a first membrane portion, a second membrane portion decoupled from the first membrane portion by a compliant membrane and a suspension member. The second membrane portion may extend radially outward from the compliant membrane attached to, and positioned between, the first membrane portion and the second membrane portion. The suspension member may extend radially outward from the second membrane portion. The compliant membrane may be more compliant than the first membrane portion and the second membrane portion. The voice coil, which is connected to a face of the membrane assembly, may be positioned concentrically outward to the first membrane portion and the compliant membrane. The driver may be a speaker driver. In addition, the first membrane portion and the second membrane portion may be substantially flat and substantially within a same plane.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description. Furthermore, the particular features, structures, configurations, or characteristics may be combined in any suitable manner in one or more embodiments. The terms "over", "to", and "on" as used herein may refer to a relative position of one feature with respect to other features. One feature "over" or "on" another feature or bonded "to" another feature may be directly in contact with the other feature or may have one or more intervening layers. In addition, the use of relative terms throughout the description, such as "top" and "bottom" may denote a relative position or direction. For example, a "top edge", "top end" or "top side" may be directed in a first axial direction and a "bottom edge", "bottom end" or "bottom side" may be directed in a second direction opposite to the first axial direction.

Figure 1:
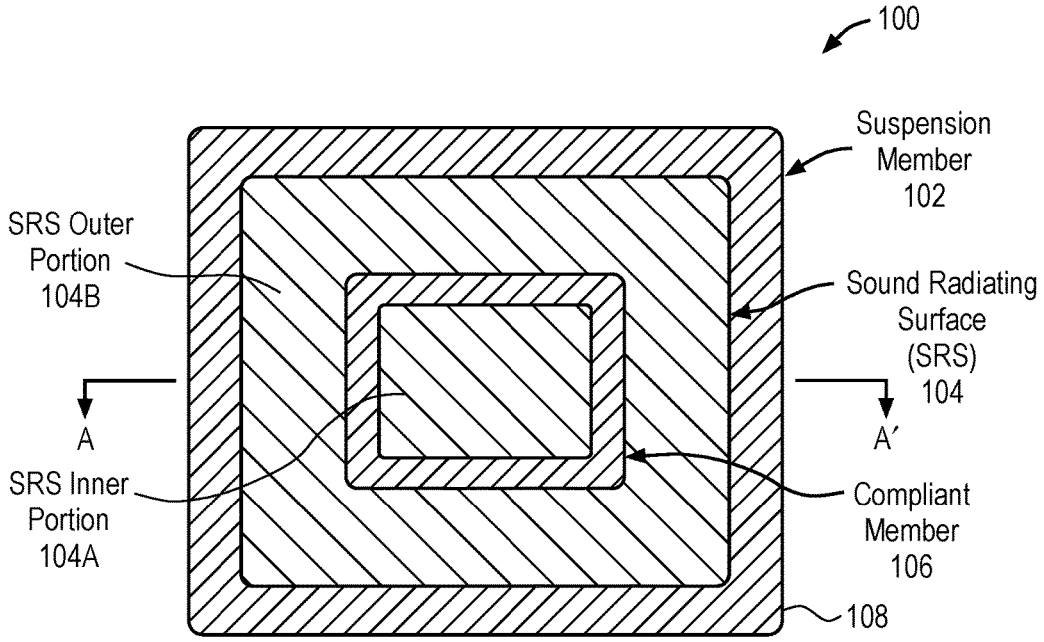
FIG. 1 illustrates a top plan view of one embodiment of a speaker membrane.

FIG. 1 illustrates a top plan view of one embodiment of a speaker membrane assembly. In one embodiment, the speaker membrane assembly 100 is dimensioned to generate sound waves when integrated within a driver. The driver may, for example, be an electric-to-acoustic transducer having membrane assembly 100 and circuitry configured to produce a sound in response to an electrical audio signal input (e.g., a loudspeaker). In some embodiments, membrane assembly 100 is configured for use within a 10 mm to 75 mm driver, for example, a 10 mm to 20 mm driver, for example, a microspeaker. In addition, although membrane assembly 100 is shown having a substantially square or rectangular profile, membrane assembly 100 may have any number of other profiles suitable for use in a driver, for example, a circular or elliptical profile.

Membrane assembly 100 may include a decoupled membrane, which is configured to extend the high frequency output of the membrane and/or driver within which it is implemented. Membrane assembly 100 may therefore also be referred to herein as a decoupled speaker membrane assembly or a decoupled microspeaker diaphragm. In particular, at some frequency, the size and lack of stiffness of the SRS encourages the appearance of partial vibrations, also known as "breakup", such that the SRS ceases to move pistonically as a rigid body causing destructive interference and loss of sensitivity. Above the frequency where this occurs, high frequency sensitivity and the speaker's bandwidth can be limited. This is particularly true in microspeakers with severe constraints on overall thickness (e.g., z-height), because it is difficult to create sufficient stiffness in the diaphragm to move the breakup mode high enough in frequency to leave the audio band. Thus, in one embodiment, the membrane assembly 100 includes a sound radiating surface (SRS) or diaphragm that is separated into two or more concentric portions separated by a compliant region, such that the inner portion (or portions) resonates at, for example, a frequency near the frequency at which the breakup mode occurs. In other words, a high frequency resonator is formed within the SRS. This can be accomplished by, for example, locally tuning the inner portion and/or compliant region to have a natural resonant frequency at, within, or above, the breakup mode frequency. This creates additional sensitivity in the high frequencies beyond that which can be achieved by homogenous diaphragm designs.

Representatively, in one embodiment, membrane assembly 100 includes an SRS 104 having an inner portion 104A and an outer portion 104B. The SRS 104 may also be referred to herein as a diaphragm or sound radiating membrane. The inner portion 104A may form a center portion of SRS 104. The outer portion 104B may be positioned radially outward to the inner portion 104A and form an outer portion of SRS 104. Said another way, the outer portion 104B may be positioned concentrically outward to the inner portion 104A. In some embodiments, the outer portion 104B forms a ring or frame around the inner portion 104A. The inner portion 104A and the outer portion 104B may be spaced a distance from one another such that the two do not directly contact one another. In one embodiment, the inner portion 104A and outer portion 104B are radially spaced a distance from one another. In this aspect, the inner portion 104A is considered decoupled, or otherwise separated from, the outer portion 104B. It should be understood, however, that although inner portion 104A and outer portion 104B are decoupled from one another, both portions are considered sound radiating surfaces that can vibrate in response to an acoustic signal and radiate sound waves for output from a driver within which the SRS 104 is incorporated. Alternatively, where the driver is a microphone, both inner portion 104A and outer portion 104B may serve as sound pick up surfaces that vibrate in response to incoming air pressure sound waves.

Inner portion 104A and outer portion 104B may be made of a same material or different materials depending upon the desired level of stiffness. For example, both inner portion 104A and outer portion 104B may be made of a polyester material such as polyethylene naphthalate (PEN) or layers of different materials (e.g., a core layer sandwiched between two aluminum layers) as will be discussed in more detail in reference to FIG. 4. Inner portion 104A will typically have a smaller surface area, size and/or mass than outer portion 104B.

The inner portion 104A and the outer portion 104B may be connected by compliant member 106. Compliant member 106 may also be referred to herein as a decoupling member. Representatively, compliant member 106 may be positioned between inner portion 104A and outer portion 104B. In other words, compliant member 106 extends radially outward from inner portion 104A to outer portion 104B, or radially inward from outer portion 104B to inner portion 104A. Compliant member 106 may, in some embodiments, partially or entirely surround, and be attached to, a perimeter of inner portion 104A. For example, in the case of a square or rectangular shaped SRS 104 having a similarly shaped inner portion 104A, compliant member 106 may surround one side, two sides, three sides or all four sides of inner portion 104A. Alternatively, where SRS 104 has a circular or elliptical profile, compliant member 106 may form a ring partially or entirely around inner portion 104A. In addition, outer portion 104B may be positioned around, and attached to, an entire perimeter of compliant member 106. Still further, in some embodiments, compliant member 106 is a membrane, which acoustically seals inner portion 104A to outer portion 104B. In other words, compliant member 106 may be a substantially non-porous sheet of material such that when it is attached to the outer and inner edges, respectively, of inner portion 104A and outer portion 104B, air cannot pass between inner portion 104A and outer portion 104B. The term "membrane" is intended to refer to a relatively thin, pliable, sheet of material that can occupy an entire space between inner portion 104A and outer portion 104B. In other words, there are no openings or gaps between interfacing edges of inner portion 104A and outer portion 104B.

Compliant member 106 may form a localized compliant region between the inner portion 104A and outer portion 104B, which is more compliant, or less stiff, than the rest of the SRS 104 (i.e., inner portion 104A and outer portion 104B). In one embodiment, the compliance of compliant member 106 may be controlled by selecting a material having a desired compliance, changing a thickness of the material, changing a surface area of the compliant member 106, or modifying the material within the region of compliant member 106, such as by anodizing the region changing the mechanical properties of the local region. It should be understood that the term "compliant" is intended to refer to a member or material used to form the member which has a relatively low modulus of elasticity or modulus of elasticity that is lower than a "stiff" material, such as inner and outer portions 104A, 104B of SRS 104, or a material used to form inner and outer portions 104A, 104B of SRS 104.

Various characteristics of the inner portion 104A and/or compliant member 106 may be used to tune the resonant frequency of SRS 104 and improve a sound output at the breakup mode frequency, as previously discussed. More specifically, the inner portion 104A and compliant member 106 can be tuned by controlling the size (e.g., area) and/or mass (e.g., thickness) of the inner portion and/or the compliance (or stiffness) of the compliant member. For example, in order to drive the natural resonant frequency of the inner portion 104A up at the breakup mode frequency, the size, area and/or mass of the inner portion 104A may be reduced, and/or the stiffness of the compliant member 106 increased. Alternatively, where it is desirable to increase the size, area and/or mass of the inner portion 104A, for example to improve sound radiation, which in turn lowers the natural resonant frequency, the stiffness of the compliant member 106 may be tuned (e.g., the stiffness increased) to drive the frequency back up to the desired range. It should be noted, however, that while the stiffness of the compliant member 106 may be increased to increase the resonant frequency in some cases, compliant member 106 is still less stiff or more compliant than inner portion 104A and outer portion 104B. By making the area around inner portion 104A, and between inner portion 104A and outer portion 104B, more compliant (or less stiff) than the rest of SRS 104, a natural resonant frequency of the inner portion 104A can be locally controlled and tuned to a higher frequency at the breakup mode frequency where a sound pressure output typically occurs.

In addition, it is contemplated that in some embodiments, the inner portion 104A and/or compliant member 106 are tuned to increase the breakup mode frequency above the working range of the driver. Since the breakup mode frequency is above the working range of the driver, any undesirable impact in sound output from the driver due to the breakup mode will go substantially unnoticed by the user. For example, in some embodiments where the working range of the driver is intended to operate in a range from about 0.02 kHz to about 20 kHz, the inner resonator or portion 104A may be tuned to encourage significant output in the upper frequency range.

The compliance or stiffness of the compliant member 106 and/or inner portion 104A may be controlled by, for example, controlling a thickness of the material, selecting a different material, and/or anodizing a portion of the material to locally tune the compliance or stiffness, as previously discussed. In still further embodiments, the compliance or stiffness may be controlled by making compliant member 106 of a material having a different density than the material used to make inner portion 104A and/or outer portion 104B. For example, compliant member 106 may be made of a first material, and inner portion 104A and outer portion 104B may be made of a second material. In one embodiment, the first material and the second material may be different materials having different stiffnesses and/or different densities.

In one embodiment, a suitable material for compliant member 106 may include, but is not limited to a material that is more compliant (or less stiff) than inner portion 104A and outer portion 104B of SRS 104. For example, a suitable material may be a very compliant material having a relatively low Young's modulus (e.g., a lower Young's modulus than inner portion 104A and outer portion 104B). A representative very compliant material having a relatively low Young's modulus may include, but is not limited to, a polymer material such as polyurethane (PU).

In one embodiment, the material of inner portion 104A and outer portion 104B of SRS 104 may be any material capable of forming a relatively stiff axially vibratable membrane. It may be further desirable that the inner and outer portion 104A, 104B be made of a relatively light and/or relatively low density material so as not to substantially increase a mass of the SRS 104 and therefore impact a desired high frequency response of the membrane assembly 100. Representatively, a suitable material for inner portion 104A and outer portion 104B may include, but is not limited to, a polyester material. A suitable polyester material may include, but is not limited to, polyethylene naphthalate (PEN). In one embodiment, the SRS 104 may be an integrally formed dome shaped structure made of a PEN thermofoil.

In other embodiments, a suitable material for inner portion 104A and outer portion 104B may include, but is not limited to, a material having a greater stiffness and/or density than the material used to make compliant member 106. For example, the material of inner and outer portions 104A, 104B may be made of a material which is at least twice as dense as the material used for compliant member 106. For example, in one embodiment wherein the material for compliant member 106 has a density of from about 0.5 to about 1.5 g cm, the material of inner and outer portions 104A, 104B may have a density of from about 2 to about 3 g cm. Representatively, inner and outer portions 104A, 104B may be made of an alloy material, more specifically an aluminum alloy material, or layers of an aluminum and core material.

In still further embodiments, it is contemplated that in addition to, or instead of, using a different material to make compliant member 106 more compliant than inner portion 104A and outer portion 104B, compliant member 106 may be thicker (along the z-axis) than portions 104A, 104B.

In addition, it is to be understood that another way to tune the resonant frequency of the inner portion 104A and/or compliant member 106 is by controlling the width of compliant member 106, or the channel formed by compliant member 106. For example, a wider compliant member 106, or channel formed between inner and outer portions 104A, 104B by compliant member 106, reduces the stiffness and lowers the resonant frequency, while a narrower compliant member 106 or channel increases the stiffness and in turn increase the resonant frequency. It should be understood, however, that in most cases, the width (or area) of compliant member 106 is less than that of inner portion 104A or outer portion 104B.

In addition it should be understood that inner portion 104A, outer portion 104B and compliant member 106 are relatively flat, planar members, and therefore have a substantially low profile in the z-height direction.

Membrane assembly 100 may further include a suspension member 102 used to suspend SRS 104 within a frame of the driver. In this aspect, suspension member 102 may extend radially outward from the outer portion 104B and have an outer edge 108 that connects to a frame member of the driver. Suspension member 102 may be formed of a relatively compliant material so that SRS 104 can vibrate when suspended within the frame by suspension member 102. Representatively, in one embodiment, suspension member 102 may be formed of a same material as suspension member 102.

Figure 2:
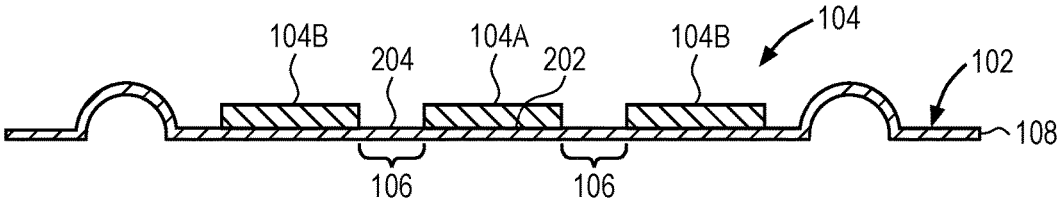
FIG. 2 illustrates a cross sectional side view along line A-A' of the membrane of FIG. 1.

FIG. 2 illustrates a cross sectional side view along line A-A' of the membrane assembly of FIG. 1. From this view, it can be seen that in some embodiments, the suspension member 102 is one continuous membrane that forms a bottom side of SRS 104. In particular, a bottom side 202 of each of the inner and outer portions 104A and 104B of SRS 104 are positioned on, and attached to (such as by gluing), a top side 204 of suspension member 102. In this aspect, the suspension member 102 extends across an entire bottom side 202 of the inner and outer portions 104A and 104B. The inner portion 104A and outer portion 104B are radially spaced from one another along the suspension member 102 and the compliant portion 106 is formed between them. In this embodiment, the compliant portion 106 is therefore formed by the portion of suspension member 102 extending between inner portion 104A and outer portion 104B of SRS 104. In other words, the compliant portion 106 is integrally formed as a single membrane with the suspension member 102. In this aspect, the inner and outer portions 104A and 104B may be substantially within one plane, and the compliant portion 106 (i.e. suspension member 102) is substantially within another plane parallel to the plane of the inner and outer portions 104A, 104B. The inner portion 104A and outer portion 104B may be formed of the same material or different materials, for example, a material or materials that are stiffer than the suspension member 102 (e.g., a polyester material). In this aspect, when inner portion 104A and outer portion 104B are attached to suspension member 102 they have the desired stiffness for sound radiation. The compliant portion 106, which is part of the suspension member 102, is formed of a different material which is more compliant than the inner and outer portions 104A, 104B (e.g. polyurethane).

Figure 3:
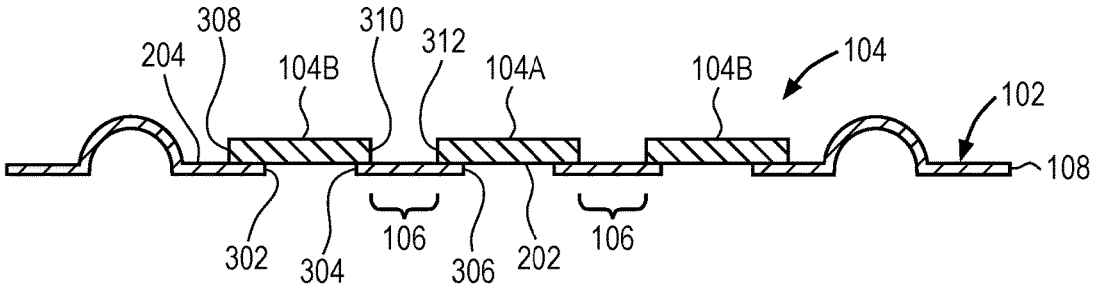
FIG. 3 illustrates a cross sectional side view along line A-A' of another embodiment of the membrane of FIG. 1.

FIG. 3 illustrates a cross sectional side view along line A-A' of another embodiment of the membrane assembly of FIG. 1. The membrane assembly of FIG. 3 is substantially similar to that of FIG. 2, except in this embodiment, the compliant portion 106 is not formed by suspension member 102. Rather, compliant portion 106 is a ring or frame shaped member that includes an outer edge 304 and an inner edge 306. The outer edge 304 of compliant portion 106 is connected to the inner edge 310 of outer portion 104B of SRS 104 and the inner edge 306 is connected to the outer edge 312 of inner portion 104A of SRS 104. For example, in one embodiment, a top face portion of inner edge 306 and outer edge 304 of compliant member 106 may be glued to a bottom face 202 of outer edge 312 of inner portion 104A and inner edge 310 of outer portion 104B, respectively. Thus, compliant member 106 separates inner portion 104A from outer portion 104B in a radial direction such that inner portion 104A does not directly contact outer portion 104B. In addition, the suspension member 102 includes an inner edge 302, which is connected to an outer edge 308 of outer portion 104B of SRS 104, and an outer edge 108 that is connected to a driver frame (not shown). In this aspect, suspension member 102 is not directly connected to, or otherwise in direct contact with, compliant portion 106 or inner portion 104A of SRS 104.

Figure 4:
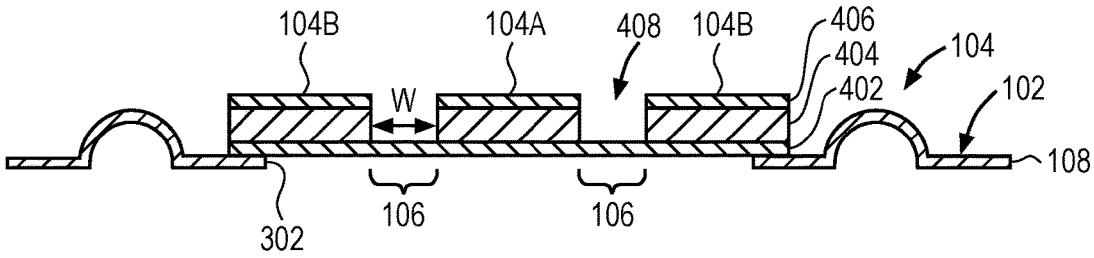
FIG. 4 illustrates a cross sectional side view along line A-A' of another embodiment of the membrane of FIG. 1.

FIG. 4 illustrates a cross sectional side view along line A-A' of another embodiment of the membrane assembly of FIG. 1. The membrane assembly of FIG. 4 is substantially similar to that of FIG. 2, except in this embodiment compliant portion 106 is formed by a layer of the material used to form a bottom face of the SRS 104. Representatively, SRS 104 is made of a first material layer 402, a second material layer 404 and a third material layer 406. The first material layer 402 and the third material layer 406 may, for example, be layers of an aluminum material or other similarly stiff material suitable for forming a speaker diaphragm. The second material layer 404 may be a layer of lightweight core material that is sandwiched between the first and third material layers 402 and 406. The lightweight core material may be any material having a relatively low mass and good internal damping properties, for example, a polypropylene, or foams such as polymethacrylimide (PMI) or foamed PET, or natural low density materials such as balsa wood. Portions of the first material layer 402 and second material layer 404 may then be removed leaving behind only the third material layer 406 to form compliant portion 106 between inner portion 104A and outer portion 104B of SRS 104. In this aspect compliant portion 106 is formed by at least one material layer (e.g. first material layer 402) of SRS 104. The inner and outer portions 104A, 104B of SRS 104 formed by a same material layer as compliant portion 106, and at least one more additional material layer, in this case, two additional material layers (e.g. second and third material layers 404, 406). It should be noted that since compliant portion 106 includes less material layers than inner and outer portions 104A, 104B, it will be more compliant (or less stiff) than inner and outer portions 104A, 104B. The number of layers used to form compliant portion 106 may, however, be modified to achieve the desired resonant frequency. For example, more material layers may be used (e.g. material layer 402 and material layer 404) to increase a thickness of compliant portion 106, and in turn, increase the resonant frequency.

In addition, a width (W) of a channel 408 formed between inner portion 104A, outer portion 104B and compliant portion 106 may, as previously discussed, be tuned to achieve a desired resonant frequency. For example, width (W) of channel 408 may be increased to reduce the stiffness of compliant portion 106 and lower the resonant frequency. Alternatively, a width (W) of channel 408 may be decreased to increase the stiffness and in turn increase the resonant frequency. It should be understood, however, that in most cases, the width (or area) of compliant member 106 is less than that of inner portion 104A or outer portion 104B.

To suspend SRS 104 of FIG. 4 from a driver frame, an outer edge of the first material layer 402 of SRS 104 may be attached to the inner edge 302 of suspension member 102. The outer edge 108 of suspension member 102 may then be attached to the driver frame, as previously discussed.

Figure 5:
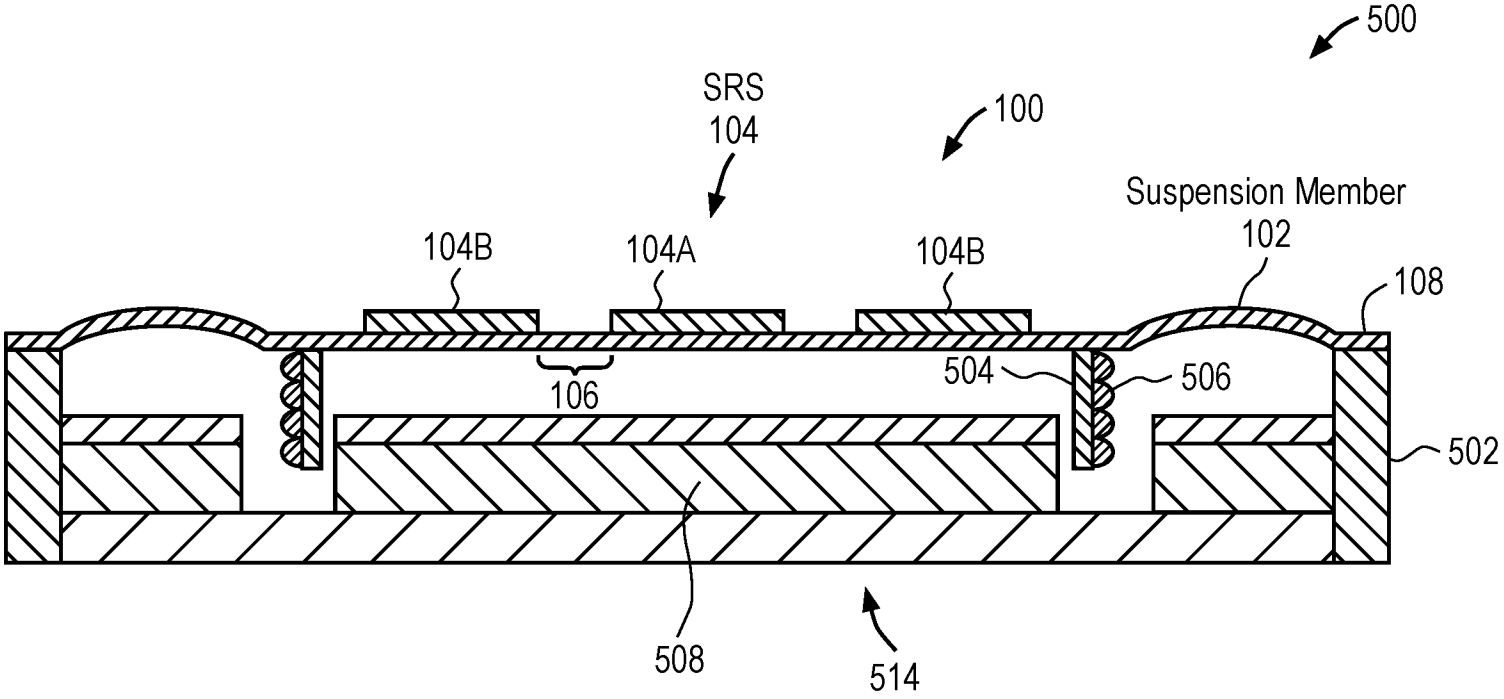
FIG. 5 illustrates a cross sectional side view of the membrane of FIG. 1 integrated within a driver.

FIG. 5 illustrates a cross sectional side view of the membrane of FIG. 1 integrated within a driver. Driver 500 may be any type of electric-to-acoustic transducer that uses a pressure sensitive diaphragm and circuitry to produce a sound in response to an electrical audio signal input (e.g., a loudspeaker). Representatively, membrane assembly 100, which includes SRS 104, having inner portion 104A and outer portion 104B decoupled by compliant portion 106, and suspension member 102 as described in reference to FIG. 1 and FIG. 2, may be integrated within driver 500 to produce a sound. The driver 500 may, for example, be a microspeaker driver. The electrical audio signal may be a music signal input to driver 500 by a sound source. The sound source may be any type of audio device capable of outputting an audio signal, for example, an audio electronic device such as a portable music player, home stereo system or home theater system capable of outputting an audio signal. Driver 500 may be integrated within headphones, intra-canal earphones, inter-concha earphones or the like.

Representatively, the outer edge 108 of suspension member 102 may be attached to frame 502 to suspend membrane assembly 100 within driver 500. Frame 502 may be part of a driver enclosure or box whose height (or rise) and speaker back volume (also referred to as an acoustic chamber) are considered to be relatively small. For example, the enclosure height or rise may be in the range of about 1 millimeter (mm) to about 10 mm. The concepts described here, however, need not be limited to driver enclosures whose rises are within these ranges.

Driver 500 may include magnet assembly 514 positioned along a face of membrane assembly 100. Magnet assembly 514 may define a gap within which a portion of coil 506 (also referred to as a voice coil) and the associated former 504, used to support voice coil 506, may be positioned. The former 504 and/or coil 506 may be attached to a face or side of the suspension member 102 facing magnet assembly 514. It is to be understood that in some embodiments, coil 506 and/or former are attached to suspension member 102 such that they are concentrically outward to the inner portion 104*a* and outer portion 104B of SRS 104 and compliant portion 106. Said another way, the decoupled portion of SRS 104 is concentrically inward of the voice coil 506 and former 504.

Coil 506, which is affixed to the former 504, may be positioned around center magnet piece 508. It is noted that although former 504 is illustrated, former 504 is optional and may be omitted in some embodiments. Coil 506 may be a pre-wound coil assembly (which includes the wire coil held in its intended position by a lacquer or other adhesive material), which may be bonded directly to former 504, for example to the outer surface wall of the former. In other embodiments, former 504 may be omitted and coil 506 may be attached directly to a surface of suspension member 102.

Although not shown, coil 506 may have electrical connections to a pair of terminals through which an input audio signal is received, in response to which coil 506 produces a changing magnetic field that interacts with the magnetic field produced by magnet assembly 514 for providing a driving mechanism for driver 500.

As previously discussed, SRS 104 may be coupled to frame 502 by way of suspension member 102. Suspension member 102 allows substantially vertical movement of SRS 104, that is in a substantially up and down direction or also referred to as a forward-backward direction, relative to fixed frame 502. Suspension member 102 may be any compliant material, such as those previously discussed, that is sufficiently flexible to allow movement of SRS 104 in order to produce acoustic or sound waves. The SRS 104 may be more rigid or less flexible, to be more efficient in producing high frequency acoustic waves. In one instance, suspension member 102 is a single-piece flexible membrane, and SRS 104 includes substantially rigid or stiff inner and outer portions 104A and 104B that may be attached to the face of suspension member 102 as previously discussed. This may be done by directly gluing inner and outer portions 104A, 104B and suspension member 102 together at their respective edges and/or faces. In addition to allowing for axial movement of SRS 104, suspension member 102 may also serve to maintain SRS 104 in substantial alignment relative to a center vertical axis of former 504 during operation of driver 500. This alignment also serves to prevent a moving coil from impacting the walls of the magnet system.

Former 504 may have a typical, generally cylindrical or ring like structure around which a voice coil can be wound. Alternatively, former 504 may be a flat plate with a central opening therein which extends substantially horizontally outward of a peripheral portion of SRS 104. Former 504 may be made from any suitably lightweight yet rigid material, so as to keep the weight of the suspended combination with membrane assembly 100 to a minimum, for greater performance and efficiency. An example material is an aluminum alloy. Other suitable materials include titanium, nomex, or kapton, which may be made sufficiently lightweight yet rigid.

Figure 6:
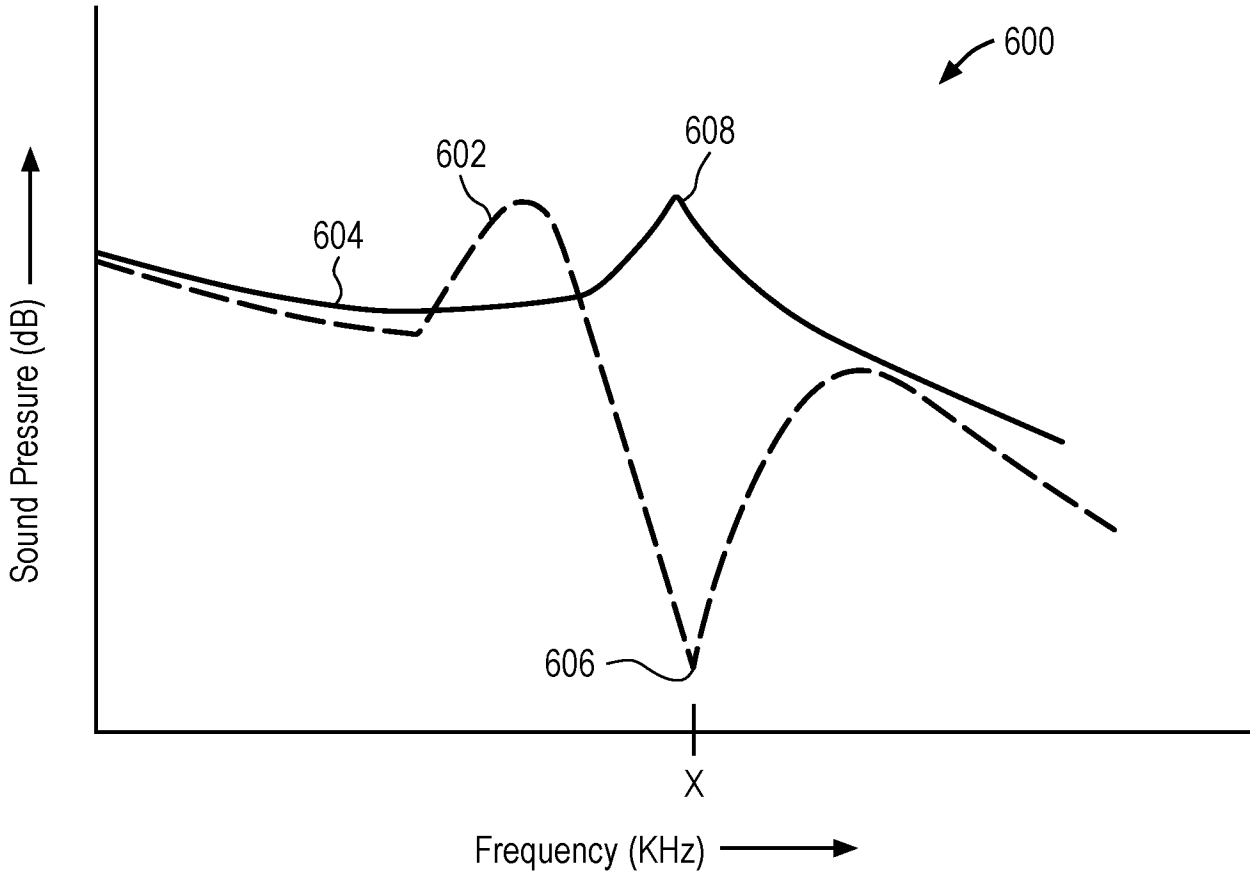
FIG. 6 illustrates a frequency response curve of a driver including the membrane disclosed herein.

FIG. 6 illustrates a frequency response curve for a driver having a decoupled membrane. In particular, frequency response chart 600 includes dashed line 602 illustrating a frequency response curve for a driver experiencing a substantial drop in sound pressure at a breakup mode frequency X (e.g., a frequency from 2 kHz to 15 kHz). The solid line 604 represents the response curve of a driver having a decoupled membrane tuned to have a natural resonant frequency at the breakup mode frequency X. In this aspect, it can be seen that due to the tuning of the membrane, there is a peak 608 (or increase) in sound pressure output at the breakup mode frequency X. In this aspect, the drop in sound pressure output at the breakup mode frequency X is now compensated by the peak 608 in sound pressure output at the breakup frequency X, and the sound output of the driver is therefore improved.

Figure 7:
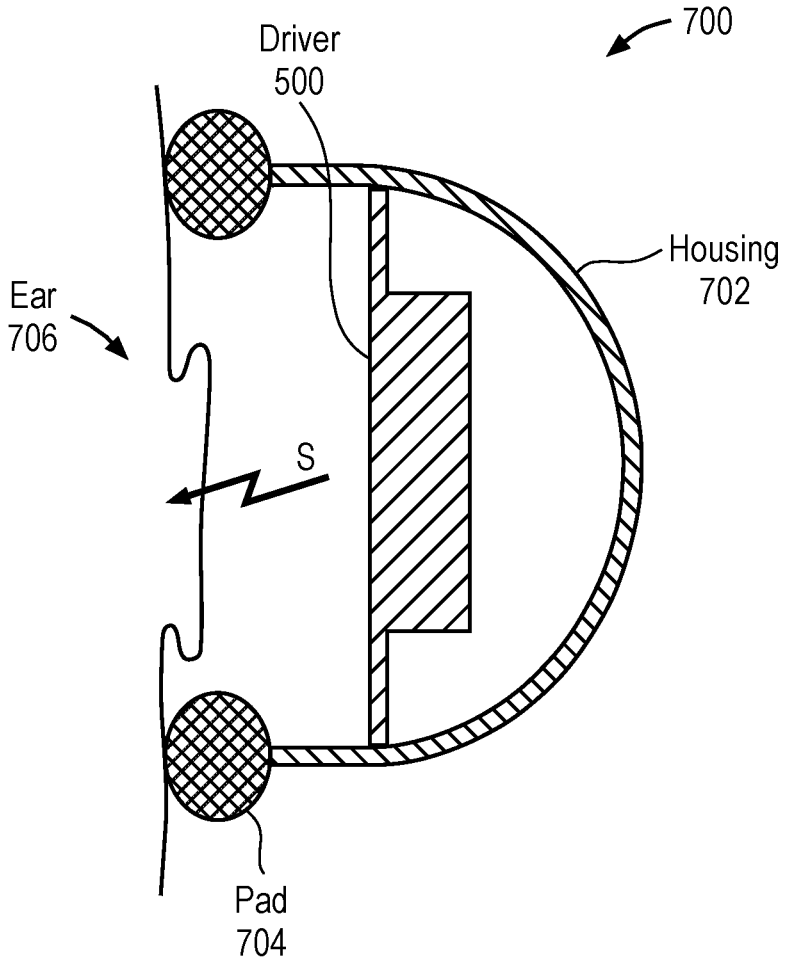
FIG. 7 illustrates one embodiment of an electronic device in which a membrane as disclosed herein may be implemented.

FIG. 7 illustrates one embodiment of an electronic device in which a membrane as disclosed herein may be implemented. Electronic device 700 may be, for example, a circumaural headphone that includes a left and right circumaural earcup connected by a headband (not shown). It should be noted that FIG. 7 illustrates only one of the pair of left and right earcups of the headphone. In this aspect, device 700 may include a housing 702 dimensioned to encircle and cover a user's ear 706 and house the driver, for example driver 500 which includes membrane assembly 100 as discussed in reference to FIG. 1-FIG. 5. In addition, in some cases, an earcup pad 704 may be positioned around the front end of the earcup to ensure a comfortable fit around the user's ear. The driver 500 may be positioned within housing 702 such that sound (S) emitted from driver 500 may be output to the user's ear 706. It should further be recognized, however, that although a circumaural headphones is described, the membrane disclosed herein may be integrated within other types of electronic devices that use a transducer, for example, an inter-canal earphone or intra-concha earphone dimensioned to fit within an ear of a user.

Figure 8:
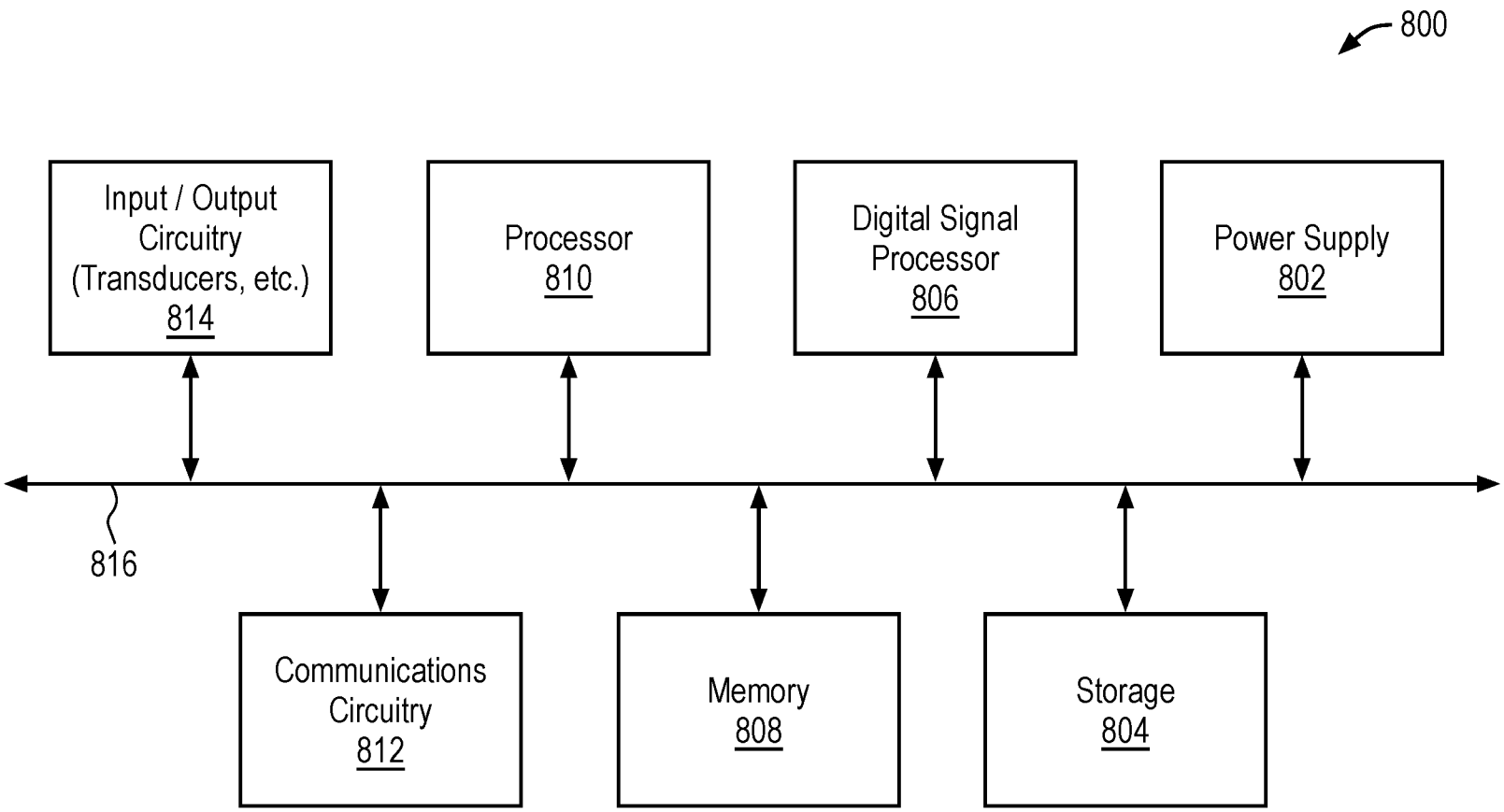
FIG. 8 illustrates a simplified schematic view of one embodiment of an electronic device in which the membrane may be implemented.

FIG. 8 illustrates a simplified schematic view of one embodiment of an electronic device in which a membrane as disclosed herein may be implemented. For example, a circumaural headphone as discussed in reference to FIG. 7 is an example of a system that can include some or all of the circuitry illustrated by electronic device 800.

Electronic device 800 can include, for example, power supply 802, storage 804, signal processor 806, memory 808, processor 810, communication circuitry 812, and input/output circuitry 814. In some embodiments, electronic device 800 can include more than one of each component of circuitry, but for the sake of simplicity, only one of each is shown in FIG. 8. In addition, one skilled in the art would appreciate that the functionality of certain components can be combined or omitted and that additional or less components, which are not shown in FIG. 8, can be included in, for example, device 800.

Power supply 802 can provide power to the components of electronic device 800. In some embodiments, power supply 802 can be coupled to a power grid such as, for example, a wall outlet. In some embodiments, power supply 802 can include one or more batteries for providing power to earphones, headphones or other type of electronic device associated with the headphone. As another example, power supply 802 can be configured to generate power from a natural source (e.g., solar power using solar cells).

Storage 804 can include, for example, a hard-drive, flash memory, cache, ROM, and/or RAM. Additionally, storage 804 can be local to and/or remote from electronic device 800. For example, storage 804 can include an integrated storage medium, removable storage medium, storage space on a remote server, wireless storage medium, or any combination thereof. Furthermore, storage 804 can store data such as, for example, system data, user profile data, and any other relevant data.

Signal processor 806 can be, for example a digital signal processor, used for real-time processing of digital signals that are converted from analog signals by, for example, input/output circuitry 814. After processing of the digital signals has been completed, the digital signals could then be converted back into analog signals.

Memory 808 can include any form of temporary memory such as RAM, buffers, and/or cache. Memory 808 can also be used for storing data used to operate electronic device applications (e.g., operation system instructions).

In addition to signal processor 806, electronic device 800 can additionally contain general processor 810. Processor 810 can be capable of interpreting system instructions and processing data. For example, processor 810 can be capable of executing instructions or programs such as system applications, firmware applications, and/or any other application. Additionally, processor 810 has the capability to execute instructions in order to communicate with any or all of the components of electronic device 800.

Communication circuitry 812 may be any suitable communications circuitry operative to initiate a communications request, connect to a communications network, and/or to transmit communications data to one or more servers or devices within the communications network. For example, communications circuitry 812 may support one or more of Wi-Fi (e.g., a 802.11 protocol), Bluetooth®, high frequency systems, infrared, GSM, GSM plus EDGE, CDMA, or any other communication protocol and/or any combination thereof.

Input/output circuitry 814 can convert (and encode/decode, if necessary) analog signals and other signals (e.g., physical contact inputs, physical movements, analog audio signals, etc.) into digital data. Input/output circuitry 814 can also convert digital data into any other type of signal. The digital data can be provided to and received from processor 810, storage 804, memory 808, signal processor 806, or any other component of electronic device 800. Input/output circuitry 814 can be used to interface with any suitable input or output devices, such as, for example, a microphone. Furthermore, electronic device 800 can include specialized input circuitry associated with input devices such as, for example, one or more proximity sensors, accelerometers, etc. Electronic device 800 can also include specialized output circuitry associated with output devices such as, for example, one or more speakers, earphones, etc.

Lastly, bus 816 can provide a data transfer path for transferring data to, from, or between processor 810, storage 804, memory 808, communications circuitry 812, and any other component included in electronic device 800. Although bus 816 is illustrated as a single component in FIG. 8, one skilled in the art would appreciate that electronic device 800 may include one or more bus components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although a two part membrane having a localized compliant region is primarily disclosed as being implemented within a speaker driver for earphones or headphones, it is contemplated that the two part membrane disclosed herein may be used within any type of driver and integrated within any type of electronic device that could benefit from an increased breakup mode frequency, for example, a notebook, laptop, smartphone or any other type of device which can be used to output sound to a user. The description is thus to be regarded as illustrative instead of limiting.

What is claimed is:

1. A decoupled speaker membrane assembly for use in a microspeaker, the speaker membrane assembly comprising:

a first membrane portion;

a compliant portion attached to, and extending radially outward from, a perimeter of the first membrane portion, wherein the compliant portion is more compliant than the first membrane portion;

a second membrane portion attached to, and extending radially outward from the compliant portion such that the second membrane portion is decoupled from the first membrane portion by the compliant portion; and a suspension member extending radially outward from the second membrane portion.

2. The speaker membrane assembly of claim 1 wherein the first membrane portion is tuned to have a natural resonant frequency at a breakup mode frequency of the decoupled speaker membrane.

3. The speaker membrane assembly of claim 1 wherein a channel is formed between the first membrane portion and the second membrane portion, and the channel is dimensioned to tune a natural resonant frequency of the first membrane portion to that of a breakup mode frequency of the decoupled speaker membrane.

4. The speaker membrane assembly of claim 1 wherein the compliant portion comprises a material having a lower Young's modulus than a material of the first membrane portion and a material of the second membrane portion.

5. The speaker membrane assembly of claim 1 wherein the second membrane portion is attached to, and extends radially outward from, an entire perimeter of the compliant portion.

6. The speaker membrane assembly of claim 1 wherein the compliant portion acoustically seals the first membrane portion to the second membrane portion.

7. The speaker membrane assembly of claim 1 wherein the first membrane portion and the second membrane portion are formed of a same material.

8. The speaker membrane assembly of claim 1 wherein the compliant portion is formed by a portion of the suspension member extending between the first membrane portion and the second membrane portion, and the first membrane portion and the second membrane portion are attached to a face of the suspension member.

9. The speaker membrane assembly of claim 1 wherein the first membrane portion and the second membrane portion comprise a plurality of material layers, and at least one of the material layers extends from the first membrane portion to the second membrane portion to form the compliant portion.

10. The speaker membrane assembly of claim 9 wherein the suspension member is attached to a face of the at least one of the material layers.

11. A decoupled microspeaker diaphragm comprising:

an inner diaphragm portion;

an outer diaphragm portion, the outer diaphragm portion being spaced radially outward from the inner diaphragm portion; and a decoupling membrane positioned between the inner diaphragm portion and the outer diaphragm portion, wherein the decoupling membrane surrounds the inner diaphragm portion and is more compliant than the inner diaphragm portion and the outer diaphragm portion.

12. The microspeaker diaphragm of claim 11 wherein the inner diaphragm portion and the outer diaphragm portion are within a first plane and the decoupling membrane is within a second plane parallel to the first plane.

13. The microspeaker diaphragm of claim 11 wherein a top side of the decoupling membrane is attached to a bottom side of the inner diaphragm portion and the outer diaphragm portion.

14. The microspeaker diaphragm of claim 11 wherein the decoupling membrane comprises an inner edge and an outer edge, wherein the inner edge of the decoupling membrane is connected to an outer edge of the inner diaphragm portion, and the outer edge of the decoupling membrane is connected to an inner edge of the outer diaphragm portion.

15. The microspeaker diaphragm of claim 11 wherein the inner diaphragm portion and the outer diaphragm portion comprise a first material layer and a second material layer, and the decoupling membrane comprises one of the first material layer or the second material layer.

16. The microspeaker diaphragm of claim 11 wherein the decoupling membrane is a continuous membrane that extends along an entire bottom side of the inner diaphragm portion and the outer diaphragm portion, and the bottom side of the inner diaphragm portion and the outer diaphragm portion is attached to a top side of the decoupling membrane.

17. The microspeaker diaphragm of claim 11 further comprising:

a suspension member extending radially outward from the outer diaphragm portion, wherein the inner diaphragm portion and the outer diaphragm portion comprise at least one different material than the suspension member.

18. A driver comprising:

a frame;

a membrane assembly for radiating sound, the membrane assembly comprising:

a first membrane portion;

a second membrane portion extending radially outward from, and decoupled from, the first membrane portion by a compliant membrane attached to, and positioned between, the first membrane portion and the second membrane portion; and a suspension member extending radially outward from the second membrane portion, and wherein the compliant membrane is more compliant than the first membrane portion and the second membrane portion; and a voice coil connected to a face of the membrane assembly, and wherein the voice coil is positioned concentrically outward to the first membrane portion and the compliant membrane.

19. The driver of claim 18 wherein the driver is a microspeaker driver.

20. The driver of claim 18 wherein the first membrane portion and the second membrane portion are substantially flat and substantially within a same plane.

* * * * *